US007086889B2

(12) United States Patent
Yin et al.

(10) Patent No.: US 7,086,889 B2
(45) Date of Patent: Aug. 8, 2006

(54) INTERLOCKING MEMBER FOR AN ELECTRICAL CONNECTOR

(75) Inventors: Hao Mai Yin, Kunsan (CN); Wei Ya Cheng, Kunsan (CN)

(73) Assignee: Hon Hai Precision Ind. Co. Ltd., Taipei Hsien (TW)

( * ) Notice: Subject to any disclaimer, the term of this patent is extended or adjusted under 35 U.S.C. 154(b) by 0 days.

(21) Appl. No.: 11/100,828

(22) Filed: Apr. 6, 2005

(65) Prior Publication Data

US 2005/0287860 A1 Dec. 29, 2005

(30) Foreign Application Priority Data

Jun. 23, 2004 (CN) ..... 2004 2 0062204

(51) Int. Cl.
*H01R 13/627* (2006.01)

(52) U.S. Cl. ..... 439/358; 439/638

(58) Field of Classification Search ..... 439/350, 439/352, 353, 357, 358, 639, 640, 76.1, 638
See application file for complete search history.

(56) References Cited

U.S. PATENT DOCUMENTS

| | | | | |
|---|---|---|---|---|
| 4,838,810 | A * | 6/1989 | Yoshimura et al. | 439/358 |
| 5,154,618 | A * | 10/1992 | Nikoloff et al. | 439/67 |
| 5,167,523 | A | 12/1992 | Crimmins et al. | |
| 5,383,794 | A * | 1/1995 | Davis et al. | 439/352 |
| 5,486,117 | A | 1/1996 | Chang | |
| 5,716,228 | A * | 2/1998 | Chen | 439/358 |
| 5,860,826 | A * | 1/1999 | Chang | 439/358 |
| 5,882,220 | A * | 3/1999 | Horii et al. | 439/297 |
| 6,146,182 | A | 11/2000 | Wang et al. | |
| 6,146,194 | A * | 11/2000 | Lok | 439/541.5 |
| 6,146,205 | A * | 11/2000 | Lai | 439/610 |

* cited by examiner

*Primary Examiner*—Tho D. Ta
*Assistant Examiner*—Vanessa Girardi
(74) *Attorney, Agent, or Firm*—Wei Te Chung

(57) ABSTRACT

An electrical connector (100) includes a module (1) having a mating portion (115) embedded with a plurality of terminals (13), an interlocking member having a press member (6) and an elongated latch member (5) assembled with the press member, and an insulative casing (3, 4) forming an extension (36, 46) to enclose the mating portion of the module and the latch member of the interlocking member.

12 Claims, 7 Drawing Sheets

INTERLOCKING MEMBER FOR AN ELECTRICAL CONNECTOR

CROSS-REFERENCE TO RELATED APPLICATION

This application is related to co-pending U.S. patent application Ser. No. 11/028,104 entitled "ELECTRICAL ADAPTER", invented by the same inventor and assigned to the common assignee as the present invention.

BACKGROUND OF THE INVENTION

1. Field of the Invention

The present invention relates to an electrical connector, and more particularly to an interlocking member for an electrical connector, providing reliable mating/unmating interface for securing the electrical connector to a mating electrical device.

2. Description of the Prior Art

Complementary electrical connectors typically include dielectric housings respectively receiving a plurality of terminals or contacts which, when the connectors are mated, establish an electrical interconnection therebetween. The complementary connectors may be male and female connectors or plug and socket connectors for electrically connecting the terminals or contacts received therein. In some instances, the connectors have complementary interlocking member for securing the connectors together when mated.

Examples of such an interlocking structure has been known in the arts as disclosed in the specifications and drawings of U.S. Pat. Nos. 5,468,117 and 5,716,288. U.S. Pat. No. 5,468,117 discloses a plug connector and a receptacle connector firmly mated by means of interlocking between a pair of notched engaging portions of the receptacle connector and a pair of flexible latch arms of the plug connector for inserting into corresponding engaging portions. In particular, each latch arm includes a press portion overmolded with an insulative body of the plug connector, and a curled latch hook extending forwardly beyond front edge of the body. U.S. Pat. No. 5,716,288 discloses a plug connector comprising a main connector body, and a pair of fastening mechanisms assembled with the connector body. In particular, the fastening mechanisms have two clamping holders fastened in slots defined at lateral sides of the connector body, and two clamping devices holded by the clamping devices and having claws forwardly extending for clamping the plug connector to a plug socket. However, the plug connectors of the prior arts involve a common problem as the latch hook of the flexible latch arms and the claws of the fastening mechanisms are exposed outside and have no any protections. This drawback will be most prominent in case of encountering impact from unexpected exterior sources so as to unfortunately influent stabilization of the electrically interconnection between the plug connector and the receptacle connector/plug socket.

In light of the problems, an improved interlocking member for an electrical connector is desired to overcome the drawback of the prior arts.

BRIEF SUMMARY OF THE INVENTION

Therefore, a main object of the present invention is to provide an improved electrical connector having an insulative casing and interlocking members assembled with the insulative casing, wherein the insulative casing provides extension to enclose the interlocking members therein so as to realize reliable interconnection between the electrical connector and a mating connector.

To fulfill the above-mentioned objects, an electrical adapter according to the present invention includes a module having a mating portion embedded with a plurality of terminals, an interlocking member having a press member and an elongated latch member assembled with the press member, and an insulative casing forming an extension to enclose the mating portion of the module and the latch member of the interlocking member.

Other objects, advantages and novel features of the invention will become more apparent from the following detailed description when taken in conjunction with the accompanying drawings.

BRIEF DESCRIPTION OF THE DRAWINGS

The foregoing summary, as well as the following detailed description of the embodiments of the present invention, will be better understood when read in conjunction with the appended drawings. For the purpose of illustrating the invention, there are shown in the drawings embodiments which are presently preferred. As should be understood, however, the invention is not limited to the precise arrangements and instrumentalities shown. In the drawings.

DETAILED DESCRIPTION OF THE PREFERRED EMBODIMENT

Figure 1:
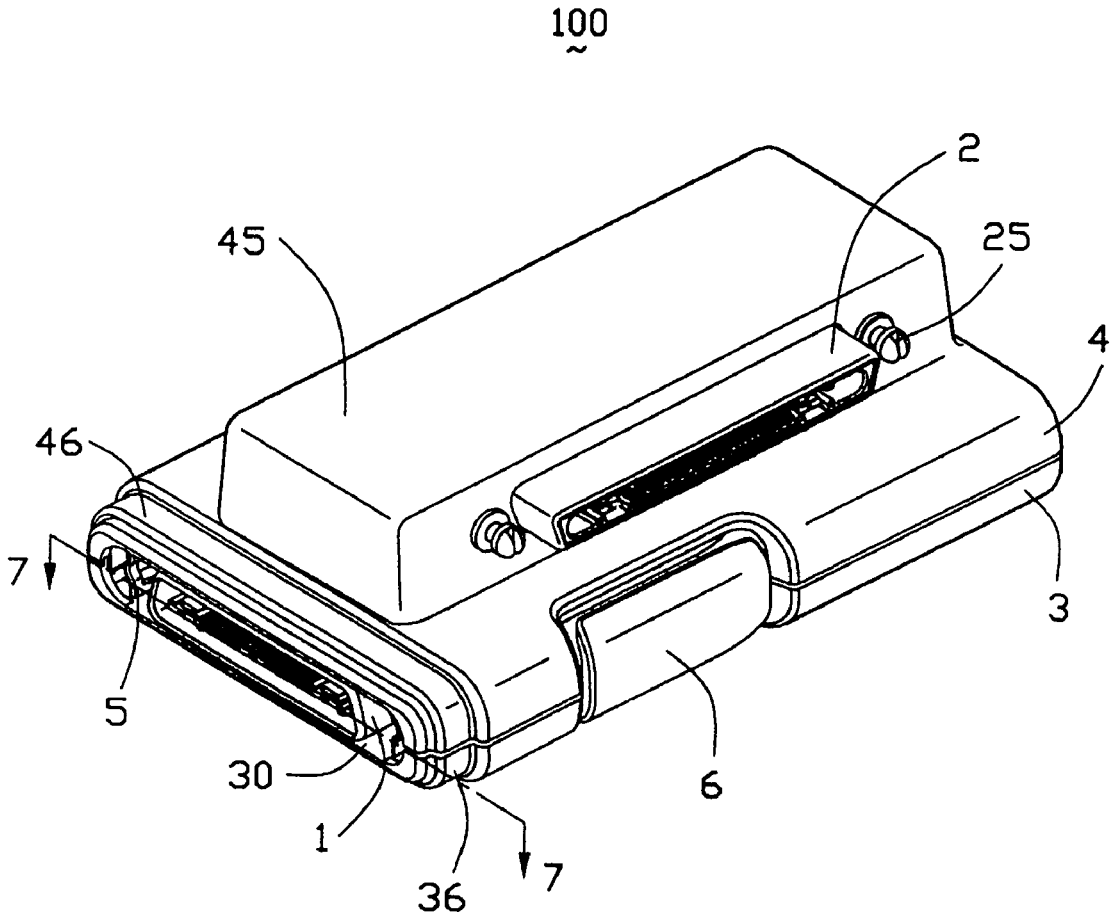
FIG. 1 is a perspective view of an electrical connector according to the present invention.
Figure 4:
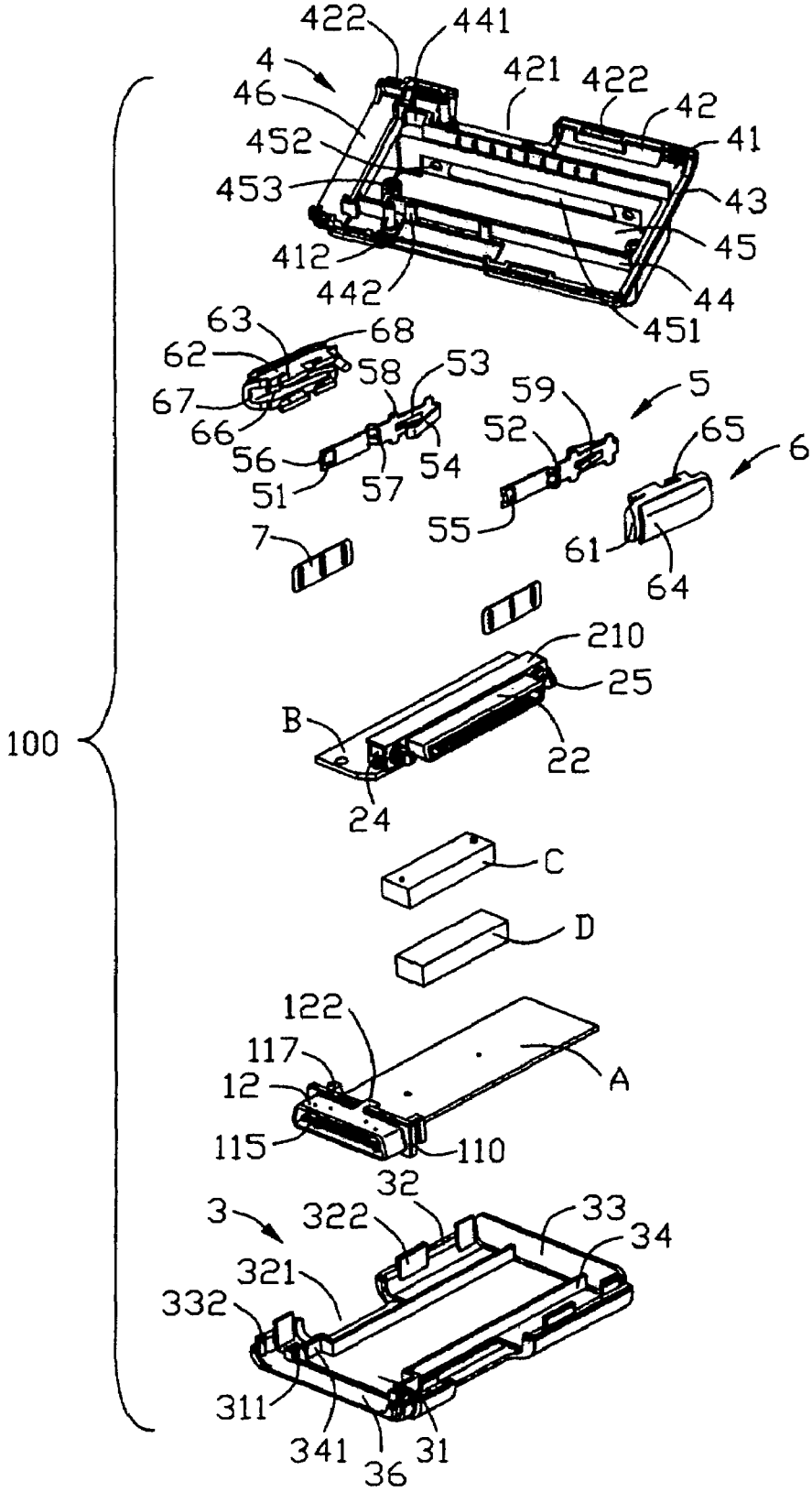
FIG. 4 is an exploded, perspective view of FIG. 2.

Referring to the drawings in greater detail, and first to FIGS. 1 and 4, an electrical connector 100 according to the present invention comprises an insulative casing, a first connector unit 1, a second connector unit 2, a printed circuit board module and a pair of interlocking members. In the preferred embodiment, the electrical connector 100 is an electrical adapter adapted for realizing electrically connection between a Notebook and a docking station. Furthermore, the insulative casing is a rectangular contour and includes a lower half 3 and an upper half 4 engaged with each other which together define a receiving space (not labeled) therebetween. The receiving space is provided with a first opening 30 occupied by the first connector unit 1 and a second opening 451 occupied by the second connector unit 2. The printed circuit board module includes a printed circuit board A electrically connected with the first connector unit 1, a printed circuit board B electrically connected with the second connector unit 2 and a pair of header C, D adapted for realizing electrically connection between the printed circuit board A and B. The detail description will be discussed hereinafter.

Figure 5:
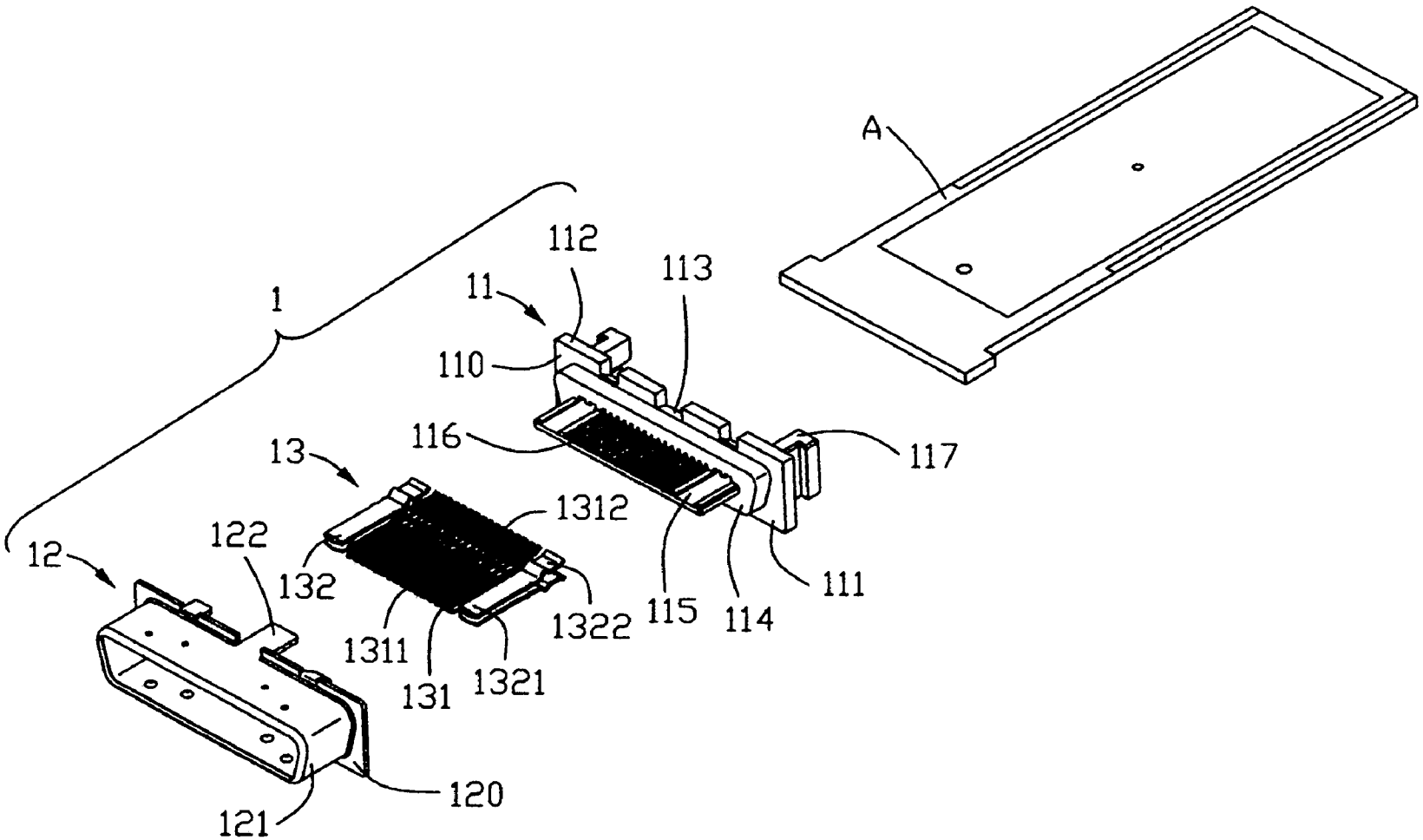
FIG. 5 is an exploded, perspective view of a first connector unit and a printed circuit board A of the electrical connector.
Figure 7:
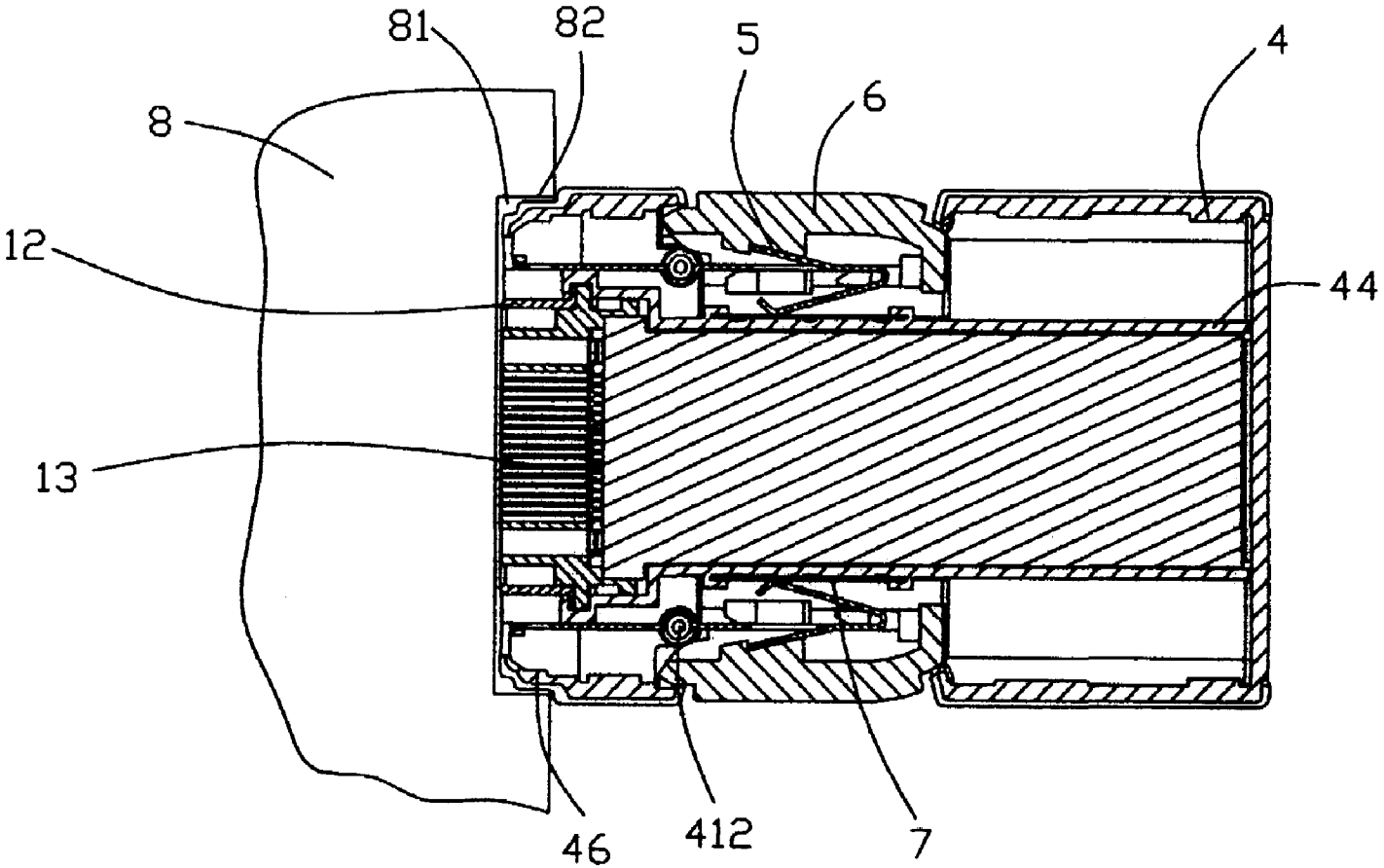
FIG. 7 is a cross-sectional view of FIG. 1 along section line 7—7.

Referring to FIG. 5, the first connector unit 1 includes a first insulative housing 11, a first metal shielding 12 and a first conductive terminal set 13. The first housing 11 has a longitudinal base 110 which defines a mating surface 111, a joint surface (not labeled) opposite to the mating surface 111, a top surface 112 interconnected with the mating surface 111 and the joint surface, and a bottom surface (not labeled) opposite to the upper surface 112. The upper surface 112 defines a recess 113 through the mating surface 111 and the joint surface. The mating surface 111 forms a generally D-shaped protrusion 114 forwardly extending from a middle region thereof, in sequence, a mating tongue 115 forwardly extends from a middle region of the protrusion 114. A plurality of passageways 116 are defined extending from the mating tongue 115 to the base 110. A pair of spaced L-shaped arms 117 rearwardly and outwardly extend from opposite sides of the joint surface wherein a space between the arms 117 is equal to width of front edge of the print circuit board A. The shielding 12 is affixed to the housing 11 and includes a flat plate 120 covering the mating surface 111, a mating frame 121 forwardly extending from the flat plate 120 to enclose the protrusion 114 and the mating tongue 115, and a tail plate 122 rearwardly extending from top surface of the mating frame 121 corresponding to the recess 113 for engagement therewith. The first terminal set 13 is arranged in upper and lower rows to be received in corresponding passageways 116 of the mating tongue 115 and includes a plurality of signal terminals 131 spaced from each other at middle region thereof for signal transmission and a plurality of power terminals 132 distributed at outmost thereof for power transmission, wherein there are two pairs of the power terminals 132 and the power terminals 132 have larger width than the signal terminals 131 in accordance with the preferred embodiment of the present invention. Each of the first terminal set 13 is generally straight in shape and has a contacting portion 1311, 1321 adapted for electrically connection with a corresponding contact of a mating connector 8 (clearly shown in FIG. 7) and a tail portion 1312, 1322 adapted for electrically connection with the printed circuit board A by known process such as soldering etc.

Figure 6:
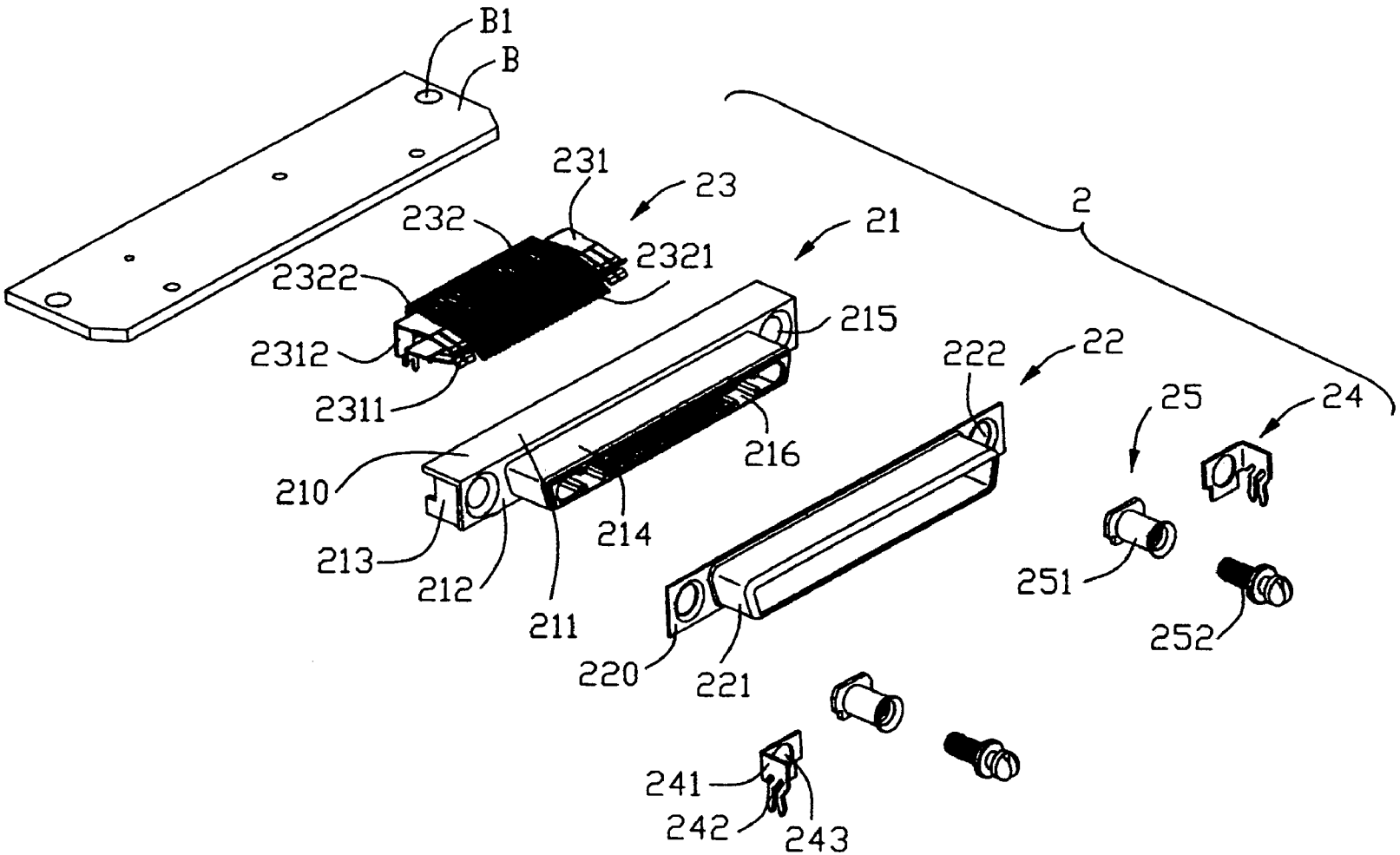
FIG. 6 is an exploded, perspective view of a second connector unit and a printed circuit board B of the electrical connector.

Referring to FIG. 6, the second connector unit 2 includes a second insulative housing 21, a second metal shielding 22, a second conductive terminal set 23, a pair of plate cushions 24 and a pair of fastening members 25. The second housing 21 has a longitudinal body 210 defining an upper surface 211, a mounting surface (not labeled) opposite to the upper surface 211 adapted for being attached to the printed circuit board B, a front surface 212, a rear surface and a pair of side surfaces 213. A D-shaped nose portion 214 forwardly extends from middle region of the front surface 212 and defines a plurality of grooves 216 at upper and lower inner walls thereof for receiving the second terminal set 23 therein. A pair of body holes 215 spaced by the nose portion 214 are defined adjacent to opposite side surfaces 213 and respectively extend through the front surface 212 and the rear surface. The second shielding 22 is affixed to the second housing 21 and includes a blade plate 220 covering the front surface 212 of the housing 21, a mating skeleton 221 forwardly extending from the blade plate 220 to enclose the nose portion 214, and a pair of blade holes 222 corresponding to the body holes 215 for uniformities therewith. The second terminal set 23 is arranged in upper and lower rows to be received in the grooves 216 and includes a plurality of signal terminals 231 spaced from each other at middle region thereof and a plurality of power terminals 232 distributed at outmost thereof. Each of the second terminal set 23 is generally L-shaped and has a mating portion 2311, 2321 adapted for electrically connection with a corresponding cable of a mating cable set (not shown) and a solder portion 2312, 2322 adapted for electrically connection with the printed circuit board B. The plate cushions 24 locate at opposite lateral sides of the base 210 and respectively have a right-angle portion 241 aligned with edges of intersected side surfaces 213 and rear surface, a pair of tags 242 downwardly extending from the right-angle portion 241 and a cushion hole 243 corresponding to the body hole 215 and the blade hole 222. The fastening members 25 are respectively assembled to opposite sides of the second connector unit 2 and include a cylindrical tube 251 defining a screw hole therein and a bolt 252 adapted for screwing into the screw hole.

Figure 2:
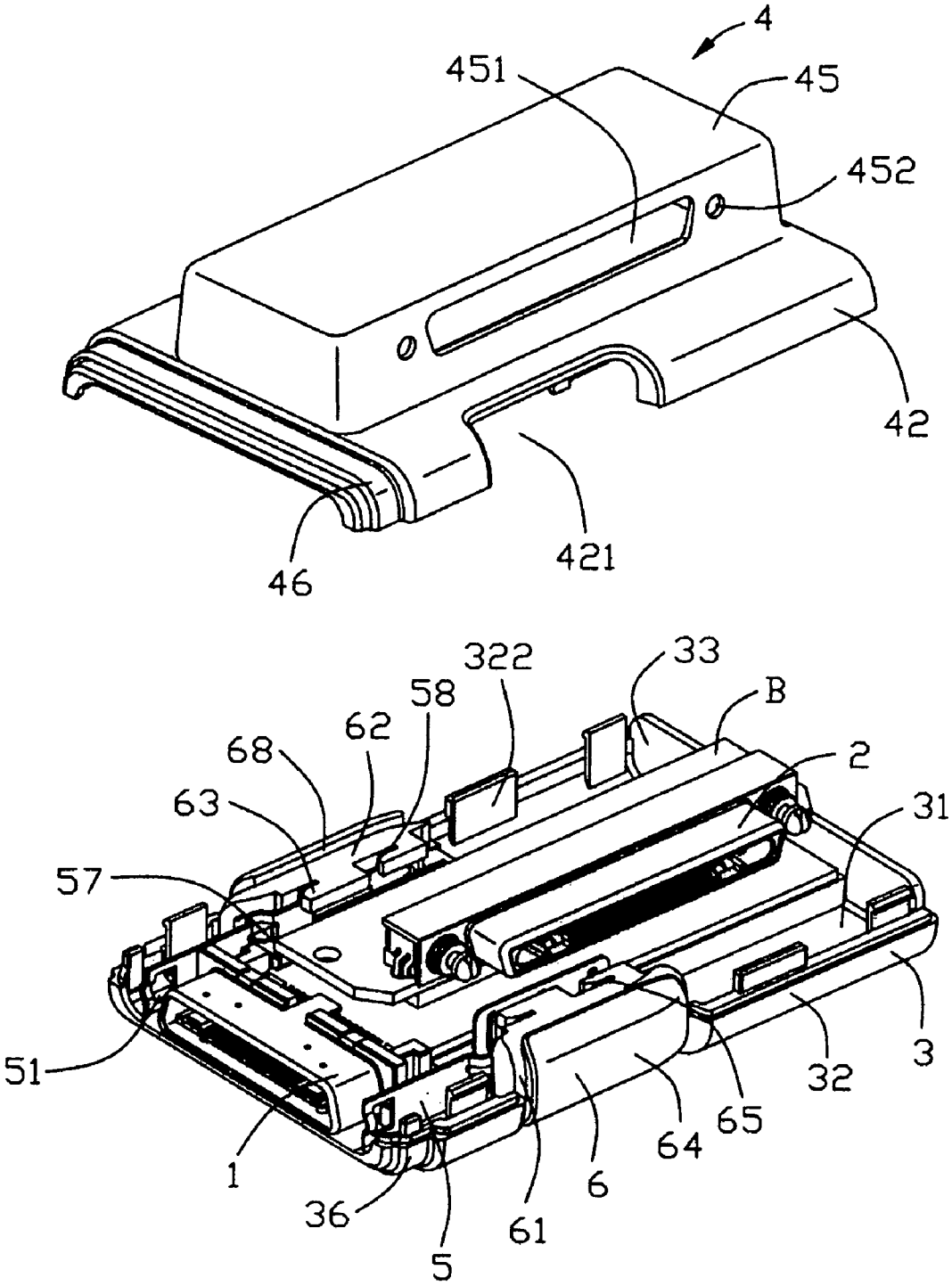
FIG. 2 is a partly, exploded view of the electrical connector of FIG. 1, wherein an upper half is taken away for explicitly showing internal structure of the electrical connector.
Figure 3:
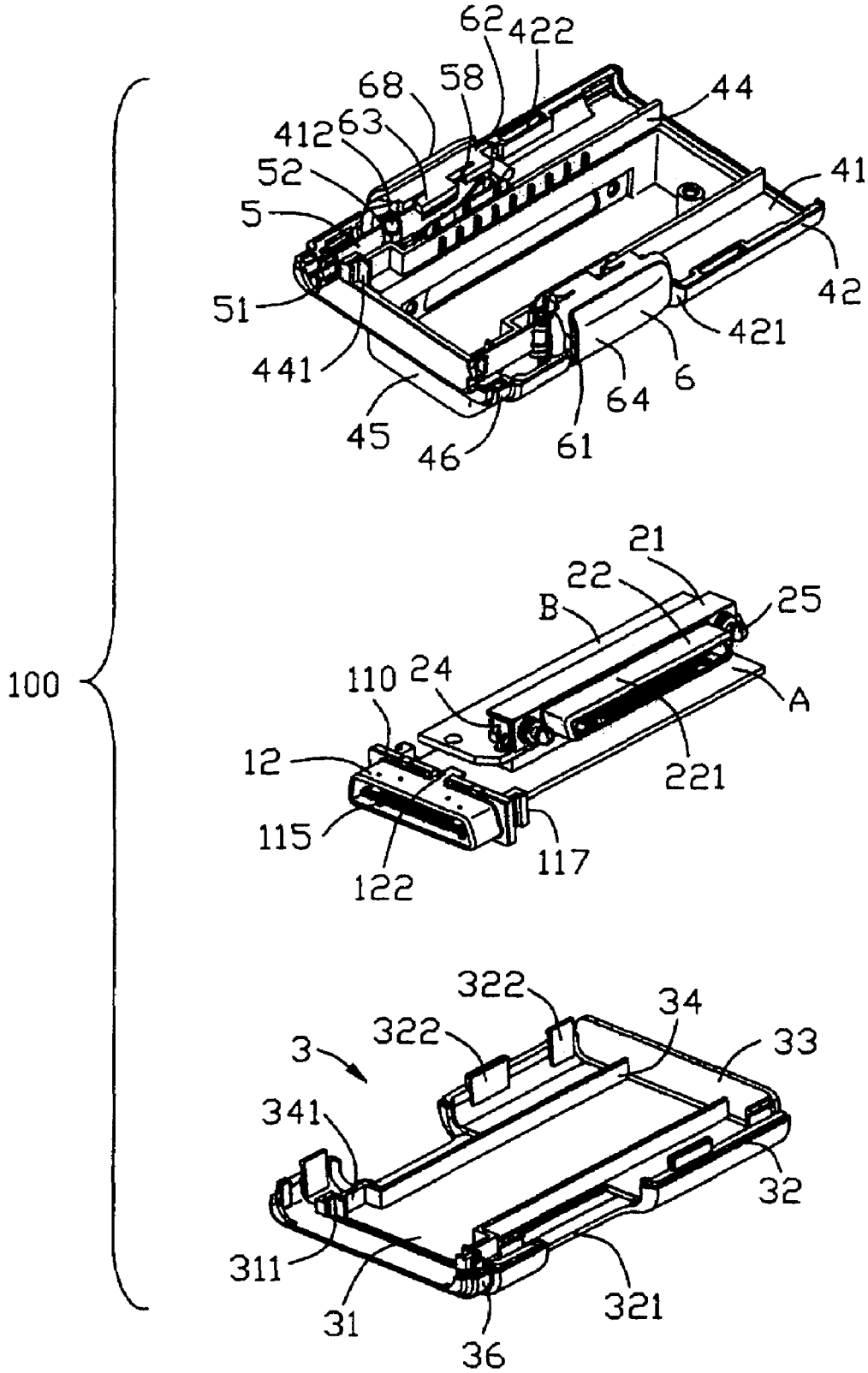
FIG. 3 is another partly, exploded view of the electrical connector of FIG. 1, wherein a lower half is farther taken away for explicitly showing internal structure of the electrical connector.

Referring to FIGS. 2 and 3, the lower and upper halves 3 and 4 are formed by die casting metallic material and respectively have a main wall 31, 41, a pair of side walls 32, 42 extending from opposite sides of the main wall 31, 41, a rear end 33, 43 connected with the main wall 31, 41 and side walls 32, 42, and an extension 36, 46 extending from front edge of the main wall 31, 41 and side walls 32, 42. The main walls 31, 41 respectively protrude a pair of shoulder portions 311, 411 adjacent to the extensions 36, 46 for commonly securing the base 110 of the first connector unit 1, and a pair of elongated partitions 34, 44 along the side walls 32, 42 for commonly securing the printed circuit board A in position. The partitions 34, 44 extend from the rear ends 33, 43 toward the shoulder portions 311, 411 and each having a stepped mounting edge 341, 441 at front edge thereof for abutting against the arm 117 of the first connector unit 1. The lower and upper halves 3, 4 respectively define a pair of notches 321, 421 at opposite side walls 32, 42 for being assembled with the interlocking members. A plurality of upwardly slices 322 extend beyond the side walls 32 of the lower half 3, and a plurality of slots 422 are defined along the side walls 42 of the upper half 4 corresponding to the configuration of the slices 322 such that the slices 322 are received in the slots 422 to joint the lower and upper halves 3, 4 together. Furthermore, the upper half 4 forms two pairs of protrusions 442 in lengthwise direction along outside of corresponding partitions 44 and a pair of dowel posts 412 in lateral direction near the stepped mounting edges 441 of the partitions 44, wherein a distance between the pair of protrusions 442 in lengthwise direction is generally equal to length of corresponding notch 421. In addition, the upper half 4 forms a generally rectangular hollow bulge portion 45 located in region between the partitions 34, 44 and the bulge portion 45 defines the second opening 451 at one of elongated sides thereof. A pair of bulge holes 452 are defined in align with the body hole 215 of the second connector unit 2 and spaced by the second opening 451. When the second connector unit 2 is affixed to the upper half 4, the tubes 251 of the fastening member 25 extend through the cushion holes 243, the body holes 215, the blade hole 222 and the bulge holes 452 in turn, and the bolt 252 screw in corresponding screw holes adapted to tie together. Furthermore, a pair of supporting posts 453 form along lengthwise direction and extend from inner surface of the bulge portion 45 for supporting the printed circuit board B in position, wherein the printed circuit board B defines a pair of supporting holes B1 corresponding to the supporting post 453.

The interlocking members are assembled to the lower and upper halves 3, 4 and each includes a latch member 5, a press member 6 and an enforcement plate 7. The latch member 5 is an elongated metal plate and includes a hook portion 51 at one end thereof for engagement with appropriate latch means of the complementary mating connector 8, a middle portion 52 defining a dowel slot 57 corresponding to the dowel post 412 of the upper half 4, a retention portion 53 formed with a plurality of stators 58 on opposite sides thereof, and a resilient portion 54 obliquely and inwardly extending from the retention portion 53. Furthermore, the retention portion 53 has an outwardly spring 59 opposite to the resilient portion 54. The press member 6 includes a main portion 61, a pair of opposite sides 62 extending from the main portion 61, a plurality of flanges 63 formed on the sides 62, a plurality of wedged slits 65 defined between the flanges 63 and the sides 62 to interferely fit with stators 58 of the latch member 5, and an operating portion 64 coving the main portion 61 to define a generally cartouche shaped surface for engagement by an operator's thumb or finger. Furthermore, the main portion 61 and the opposite sides commonly define a channel 67 therebetween. An inclined projection is formed along the channel to support the spring 59 of the latch member 5. A pair of elongated stopper 68 go over edges of the main portion 61 for preventing the interlocking members from been overpressed. The enforcement plates 7 are inserted into gaps defined between the lengthwise protrusions 442 and the partitions 44, wherein the length of the enforcement plate 7 is generally equal to the distance between the lengthwise protrusions 442.

When the interlocking members are assembled in position, the press members 6 are exposed out of the notches 321, 421, and the latch members 5 extend into the first opening 30 along inner sides of the casing and the hook portions 51 enclosed within the extensions 36, 46 of the upper and lower halves 3, 4. The resilient arms 54 of the latch members 5 bias against the enforcement plate 7, the springs 59 opposite to the resilient arms 54 are supported by the inclined projections 66. When the first connector unit 1 is going to mate/unmate the mating connector 8, the operating portions 64 are pressed and the main portions 61 inwardly deflect the retention portions 53, thereby rendering the hook portion 51 to enter into/withdraw from the mating connector 8 and allowing the mating/unmating occurs. As clearly shown in FIG. 7, when the first connector unit 1 mates with the mating connector 8, the first opening 30 enters into the opening 81 of the mating connector 8 and the extensions 36, 46 bias against inner side walls 82 of the opening 81. It should be noted that employing the extensions 36, 46, the electrical connector 100 is greatly improved stabilization of interconnection. And the hook portions 51 of the latch members 5 are enclosed within the extensions 36, 46 such that decreasing the possibility of encountering impact from unexpected exterior sources, thereby ensuring the mechanically and electrically interconnection therebetween.

It is to be understood, however, that even though numerous, characteristics and advantages of the present invention have been set fourth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector adapted for establishing an electrical connection with a mating connector, the electrical connector comprising:

an insulative casing defining a first opening communicating with an exterior in a front-to-back direction and a second opening;

a first connector unit disposed in the first opening and having a first mating port extending along a transverse direction perpendicular to said front-to-back direction and equipped with a plurality of terminals for mating with the mating connector, a metallic shield enclosing said first mating port;

a second connector unit disposed in the second opening and having a second mating port; and an interlocking device located by two sides of said metallic shield along said transverse direction and having a press member and a latch member associated with the press member for securing the connector unit with the mating connector, wherein said insulative casing forms an extension to substantially enclose both the metallic shield of the first connector unit and the latch member of the interlocking member therein; and said second connected unit occupying the second opening is electrically connected with the first connector unit via a printed circuit board module sandwiched therebetween.

2. The electrical connector as described in claim 1, wherein the press member is attached on one side of the insulative casing and exposed out of the side of the casing.

3. The electrical connector as described in claim 1, wherein the interlocking device further has an enforcement plate received in the casing and opposite to inside of the press member.

4. The electrical connector as described in claim 3, wherein the latching member comprises a retention portion assembled with the press member, a middle portion, a hook portion at distal end thereof, and a resilient portion obliquely and inwardly extending from the retention portion with enough flexibility to abut against the enforcement plate.

5. The electrical connector as described in claim 4, wherein the retention portion formed with a plurality of stators on opposite sides thereof, and wherein the press member comprises a main portion and a plurality of flanges formed on opposite side of the main portion to define a plurality of slits therebetween for interferely fit with the stators.

6. The electrical connector as described in claim 4, wherein the retention portion has an outwardly spring opposite to the resilient portion, and wherein the inside of press member forms an inclined projection supporting the spring.

7. The electrical connector as described in claim 4, wherein the middle portion defines a dowel slot, and wherein the casing forms a dowel post for being pivotally mounted in the dowel slot.

8. The electrical connector as described in claim 1, wherein the casing has an upper half and a lower half engaged with each other, the upper portion and the lower portion respectively defining a notch for commonly receiving the interlocking device.

9. The electrical connector as described in claim 8, wherein the upper and lower halves respectively have a main wall, a pair of side walls, and wherein the extension of the casing extending from front edges of the main wall and side walls to form the mating port.

10. The electrical connector as described in claim 9, wherein the mating port is a first opening, and wherein the electrical connector comprises a second opening at one side of the upper half.

11. The connector as claimed in claim 1, wherein a front edge of said extension is essentially flush with that of the metallic shield.

12. An electrical connector adapted for establishing an electrical connection with a mating connector, the electrical connector comprising:

a module having a mating portion embedded with a plurality of terminals for mating with the mating connector;

an interlocking device having a press member and an elongated latch member assembled with rhe press member for securing the connection with mating connector; and an insulative casing forming an extension to enclose the mating portion of the module and the latch member of the interlocking member, wherein the casing has an upper half and a lower half engaged with each other, the upper portion and lower portion respectively defining notch for commonly receiving the interlocking device; wherein the upper and lower halves respectively have a main wall, a pair of side walls, and wherein the extension of the casing extending from front edges of the main wall and side walls to form the mating port; wherein the mating port is a first opening, and wherein the electrical connector comprises a second opening at one side of the upper half; and wherein the first opening opens an exterior along a lengthwise direction and the second opening opens an exterior along a lateral direction, and the first and second openings are on different levels;

the module is a first connector unit occupying the first opening, and a second connector unit occupying the second opening which is electrically connected with the first connector unit via a printed circuit board module sandwich therebetween.

* * * * *